United States Patent [19]

Melchinger

[11] 3,973,881

[45] Aug. 10, 1976

[54] VANE-TYPE PUMP OR MOTOR WITH UNDERVANE FLUID BIAS

[75] Inventor: Wilhelm Melchinger, Unterensingen, Germany

[73] Assignee: Daimler-Benz Aktiengesellschaft, Germany

[22] Filed: Feb. 5, 1975

[21] Appl. No.: 547,165

[30] Foreign Application Priority Data

Feb. 6, 1974 Germany ..... 2405574
May 14, 1974 Germany ..... 2423474

[52] U.S. Cl. ..... 418/81; 418/82; 418/269

[51] Int. Cl.[2] ..... F01C 21/00; F03C 3/00; F04C 15/00

[58] Field of Search ..... 418/81, 82, 268, 269; 417/204

[56] References Cited

UNITED STATES PATENTS

| | | | |
|---|---|---|---|
| 2,255,786 | 9/1941 | Kendrick | 418/81 |
| 3,447,477 | 6/1969 | Pettibone | 418/268 |
| 3,598,510 | 8/1971 | Aoki | 418/82 |

*Primary Examiner*—John J. Vrablik
*Attorney, Agent, or Firm*—Craig & Antonelli

[57] ABSTRACT

A vane-pump or motor which includes a rotor equipped with vanes slidable within at least approximately radial slots and with an endless cam surface which surrounds the rotor and together with the same forms a sickle-shaped working space; the cam surface is so shaped that it includes a radially outwardly directed inclination with respect to a circular cam concentric to the center of rotation of the rotor which forms the suction area and in other circumferential areas, it includes a radially inwardly directed inclination, forming the discharge area; two base plates are provided which axially sealingly enclose the rotor together with the vanes and the cam ring and which axially delimit the working space or spaces; internal channels connect the suction or inlet area of the working space with the feed line and the discharge area of the working space with the discharge channel; an unobstructed working medium supply is also provided out of the channel subjected to the higher pressure level which leads to the slot bottoms of the rotor disposed in the suction or inlet area by way of flooding channels while a throttled working medium discharge exists out of the slot bottoms of the vanes disposed in the discharge area which leads to the high pressure side of the installation by way of emptying channels, which includes at least in part a by-pass by way of at least some of the slot bottoms disposed in the suction or inlet area while the flooding channels to these slot bottoms terminate in the slot bottoms in an axial location disposed downstream with respect to the connecting place of the discharge channels as viewed in the flow direction of the working medium discharge.

32 Claims, 6 Drawing Figures

FIG. 1
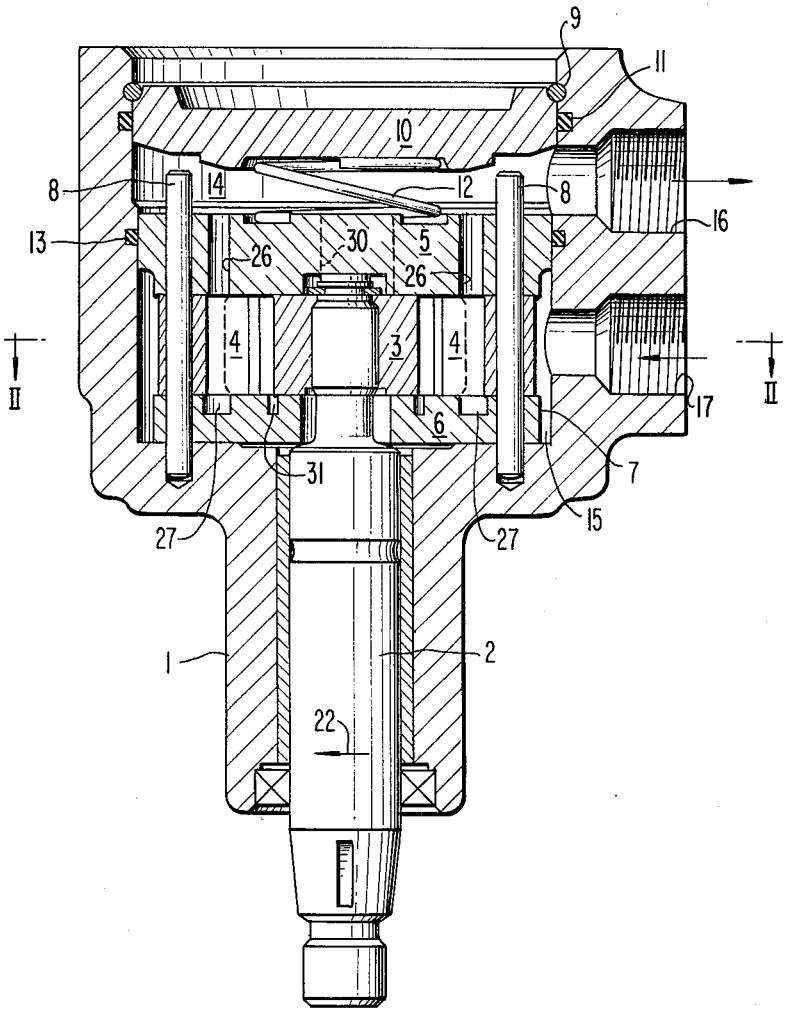
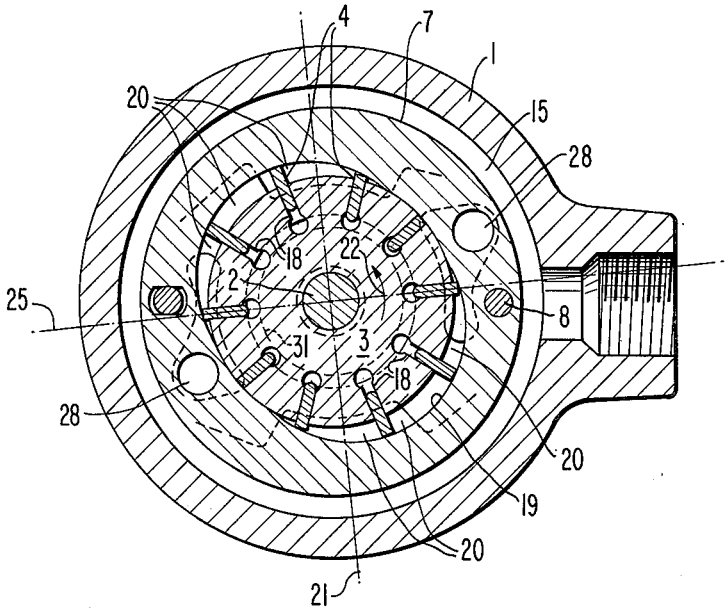
FIG. 2

FIG. 3
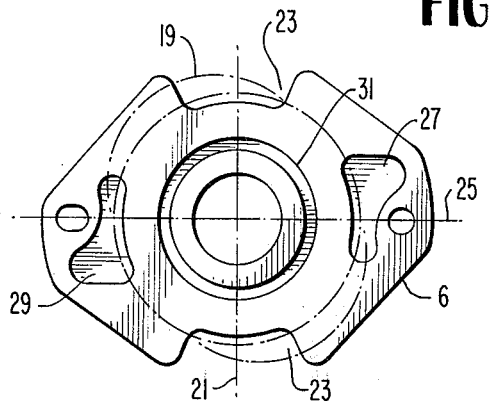
FIG. 4
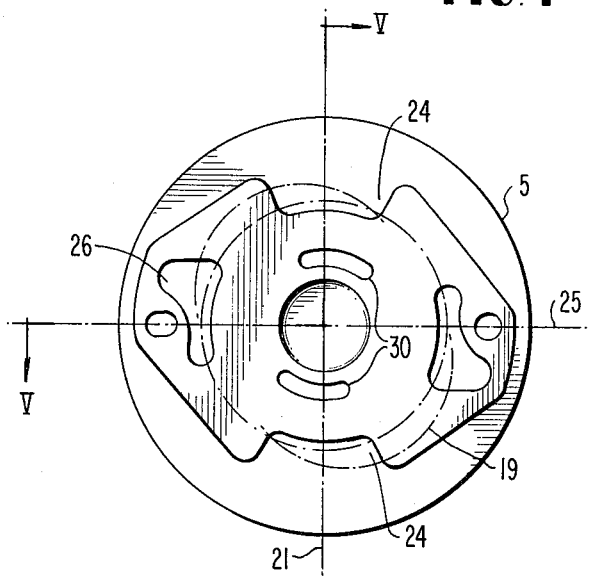
FIG. 5
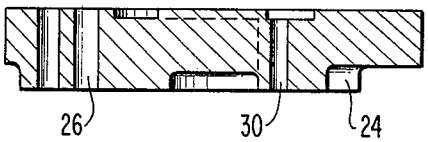
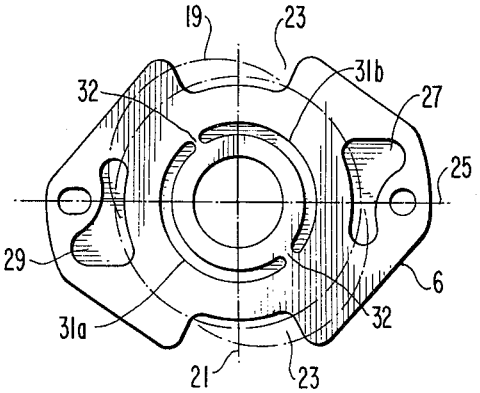
FIG. 6

VANE-TYPE PUMP OR MOTOR WITH UNDERVANE FLUID BIAS

The present invention relates to a vane cell device for liquid flow media, especially to a vane pump or motor with a rotor provided with vanes slidable in at least approximately radial parallel-walled slots and with an endless cam surface which surrounds the rotor and together with the same encloses radially at least one sickle-shaped working space, in which the cam surface includes a radially outwardly directed inclination (suction or inlet area) with respect to a circular path concentric to the center of rotation of the rotor when running over the cam surface in one predetermined direction (operating direction of rotation) and other circumferential areas of the cam surface, in which the corresponding inclination is directed radially inwardly (discharge area), whereby the rotor and the vanes and preferably also the ring or the like carrying the cam surface all possess axially an identical length and are delimited by plane, axially perpendicularly surfaces, and which further comprises two plane base plates axially sealingly enclosing the rotor together with the vanes and the cam surface on both sides and axially delimiting the working space or spaces, as well as internal connecting channels connecting the suction or inlet area of the working space with the feed line of the installation and the discharge area or areas of the working space with the discharge channel of the installation, and further equipped with an unobstructed working medium supply out of the one of the two channels consisting of feed and discharge channel which is subjected to the higher pressure level or out of the corresponding internal connecting channel or channels of the installation (high pressure side) to the slot bottoms of the rotor disposed in the suction or inlet area or areas by way of flooding channels and with a throttled working medium discharge out of the slot bottoms of the rotor disposed in the discharge area or areas to the high pressure side of the installation by way of discharge or emptying channels.

Known pumps of this construction are used for numerous possible feed and pressure-producing tasks thus, for example, also for producing pressure in hydraulic servo-steering systems in motor vehicles. The vanes of these vane pumps are pressed radially against the cam surface, inter alia, by the liquid pressure. More particularly, the vanes are subjected to the centrifugal force, to a liquid pressure prevailing in the slot bottom and eventually with certain types of construction to the pressure of a spring. A reliable vane abutment, on the other hand, is necessary for a completely satisfactory filling of the feed cells and for the pressure production. Within the suction or inlet area, apart from the centrifugal force and an eventual spring pressing action, the vanes of the aforementioned type are forced into abutment by the pressure produced by the pump; within the pressure area, they are subjected to a back-pressure built up in the slot bottom which is higher than the feed pressure of the pump. The vanes which slide radially to and fro during rotation of the rotor, more particularly, operate together with the rotor slots like a radial piston pump whose pressure area and suction or inlet area are disposed in-phase in the circumferential direction with the corresponding areas of the vane pump. This small auxiliary feed or supply flow produced by the pump action of the vanes is held back or dammed up in the pressure area by a throttle and thus effects the radial abutment of the vanes at the cam surface. A second pressure increase step which supplies the auxiliary feed stream and which builds up on the feed level of the vane pump is formed so to speak of, whose feed flow is utilized and dammed up as back pressure for purposes of vane abutment.

Advantageous in vane-type cells is their low-noise operation combined with a relatively simple construction whereby the pump is inexpensive and operationally reliable and prone to few troubles and failures. These advantages open up to the pump also application possibilities in those cases where only very small feed quantities are required, for example, with the servo-steering systems or in the so-called comfort-hydraulics of the motor vehicle construction. The small types of construction, however, entail a disadvantage which becomes noticeable above all also particularly aggravatingly when the pump is operated in cold ambient temperatures. This disadvantage resides in that after an operating stoppage during which the pump and the flow medium are cooled off to the ambient temperature, the pump commences to feed only above a predetermined initial rotational speed dependent on the oil viscosity, and upon exceeding this rotational speed, a pressure build-up starts in the feed line suddenly. This stems from the fact that, on the one hand, the vanes during each rotation of the rotor are forcibly displaced at least once again radially inwardly and that, on the other, as long as the pump itself does not feed, the liquid pressures which cause abutment of the vanes cannot build up, but only the centrifugal forces are effective. As to the rest, a spring installation in the slot bottom is not acceptable in small pump constructions. With smaller pump constructions, the centrifugal forces reach a significant magnitude only with relative high rotational speeds by reason of the slight vane weight, for example, of about two to three grams. The centrifugal force, more particularly, not only has to overcome the adhesive force of the oil but must also be so large that it is able to suck in the viscous oil into the slot bottom in the short period of time during the passage of a vane through the suction area, by an amount corresponding to the displacement volume of the vane. For that purpose the pump must have exceeded at least for a short period of time, the initial rotational speed at which these oil forces are overcome by reason of the centrifugal force influence. The colder and the more viscous the oil, the higher this initial rotational speed, and not only because the oil is more viscous but also because at the higher rotational speed, the filling time of the slot bottoms are shorter. This may lead at especially low temperatures to the fact that the oil present in the interior of the pump and the pump parts have to be warmed up at first by an idling rotation of the pump by reason of the friction loss in order that the oil can assume a smaller viscosity. If the vanes of the rotor are thus once caused to abut after exceeding the initial rotational speed, then the pump begins to feed and a pressure is able to build up in the feed line; this pressure then also contributes to the abutment of the vanes. Since this start of the feed action and of the pressure build-up takes place at high pump rotational speeds, the pump produces a forceful, strong pressure shock with the beginning of the feed.

The vane pumps of the aforementioned type commence to operate from the cooled-off condition initially only with a delay as regards rotational speed and- /or time and the feed and the pressure build up start shock-like. This is at least very annoying even if not non-permissive for the hydraulic system to be fed by the pump. However, these pressure shocks may also produce in due course damages resulting therefrom. With the use in servo-steering systems, this pressure shock, which becomes effective as a strong jerk at the steering wheel, may lead to frightening the driver and to an anxiety and apprehension on the part of the driver concerning the operating safety of the steering system. The described starting difficulties may also occur in vane-type mechanisms which are used as hydraulic motor.

It is the aim of the present invention to so improve the installation of the aforementioned type that the liquid pressures causing abutment of the vanes can build up with a viscous flow medium already at very small rotational speeds. This is achieved according to the present invention in that the working medium discharge out of the slot bottoms of the vanes disposed in the discharge area or areas, takes place at least partly by way of a by-pass via at least one partial area of the axial extent of the slot bottoms of the rotor disposed in the suction or inlet area or areas and in that the flooding channels to these slot bottoms terminate in these slot bottoms at an axial position disposed upstream in the flow direction of the working medium discharge with respect to the connecting place of the discharge channels.

The system, consisting of cam surface, vanes and rotor slots may—as already mentioned—be considered as a small radial piston pump or motor. Thanks to the by-pass according to the present invention of the discharge of the flow medium of this radial piston installation out of the slot bottoms which become smaller within the discharge area of the rotor, by way of the slot bottoms disposed in the suction or inlet area of the rotor, the discharge side of this radial piston pump or motor is at least partially by-passed or short-circuited with the suction or inlet side thereof and the volume forcibly displaced out of the slot bottoms in the discharge area is initially fed into the slot bottoms disposed in the suction or inlet area which become wider, and can build up thereat a pressure cushion which displaces the vanes toward the outside. The oil volumes present in the slot bottoms are therefore fed to and fro on the inside of the rotor without the fact that a feed toward the outside could be determined. The further aforementioned auxiliary flow is by-passed or short-circuited in itself. Only at the slot bottoms which are disposed in the suction or inlet area, the short-circuited or by-passed system is connected to the high pressure side of the vane cell mechanism, properly speaking, in order to superimpose from there a pressure corresponding to the high pressure level of the pump or of the motor and to be able to replenish the leakage losses in the by-passed or short-circuited system.

The advantages of the present invention in an application to pumps reside in that the feed of the pump or motor commences during the starting phase already at very low rotational speeds even with a viscous oil and at low temperatures and in that a pressure commences to build up corresponding to the supply flow increasing with the rotational speed, in the hydraulic system connected downstream and more particularly softly and controllably but very early. The early and soft start of the feed action additionally eliminates during the beginning of the feed or supply vacuum shocks at the pump suction side on the liquid which is viscous at the low temperatures. Heretofore, vacuum shocks could be observed which by reason of the oil viscosity could not be decreased sufficiently rapidly by an otherwise existing flow of working oil out of the hydraulic system and led to non-permissively high vacuums in the suction space over non-permissively long periods of time. Normally, the shaft seal is connected at that place where the pump shaft extends through the housing, with the suction or inlet space of the pump or motor so that the pressure differences during the pumping start can be conducted on to the shaft seal. With non-permissively high and non-permissively long-lasting pressure vacuums, however, the sealing lip might be lifted off from the pump shaft as a result thereof and air, water or dirt can be sucked-in or sniffled-in into the working oil. This not only leads to oil contaminations, pump wear and premature oil aging, but also to a temporarily disturbing noise annoyance until the sucked-in or sniffled-in air inclusions are again eliminated out of the oil. The early and soft feeding start of the pump also permits the use of oil types of higher viscosity and better lubricating properties than heretofore, whence the operating properties of the pump, its length of life, and its volumetric efficiency are improved. With the application of such pumps to motor vehicle servo-steering systems, the advantages follow therefrom that after a cold start the steering assist is present immediately and that the disturbing turning jerk at the steering wheel is avoided. Since a waiting duration for the starting of the steering assist is dispensed with, also a transition from a steering free of servo-assist to one with servo-assist is eliminated which even without a jerk-like transistion, represents a moment of insecurity because the steering forces required by the driver change thereby and an unintentional "pulling" of the steering wheel is possible.

In a constructively particularly simple manner this by-pass according to the present invention of the feed and suction spaces of the system acting as radial pump of the vanes and of the slot bottoms in the rotor as well as the pressure superimposition of the vane pump at the suction or inlet side of this "auxiliary" pump can be effected in that all slot bottoms of the rotor are in flow communication with one another by way of at least one annular channel, especially by way of an annular groove and in that only the slot bottoms of the rotor disposed in the suction area or areas are in communication directly with the high pressure side of the installation and in that the connecting places of the annular channel with the slot bottoms have as large an axial distance as possible from the connecting place of the flooding channels with the slot bottoms. The large axial distance of the annular channel effecting the flow by-pass on the one hand, and of the pressure-superimposing inlet line, on the other, brings about that the feed volume of the "auxiliary" pump displaced in the pressure area is again absorbed in the suction or inlet area thereof to as large a proportion thereof as possible before the possibility exists therefor to flow off into the pressure connection of the main pump. An outward movement of the vanes in the suction or inlet area of the vane pump is reliably achieved thereby. In order to further increase this effect, provision may be made that the slot depth and the contour of the vane edge facing the slot bottom as well as the contour of the slot bottom itself are so constructed that the remaining open cross section between vane edge and slot bottom is as small as possible in the furthest radially retracted position of the vane. By reason of this narrow construction of the discharge paths out of the feed or supply spaces of the auxiliary pump, the possibility or the tendency to enlarge these paths, i.e. to radially displace the vanes out of the slots, is still further increased.

The axial distance of the by-pass line and of the flooding line and therewith the pressure effect on the vanes is particularly large when the connecting places of the annular channel and of the flooding channels with the slot bottoms are arranged at the two axially mutually opposite end faces of the rotor.

In a constructively particularly simple manner, the annular channel may be constructed as an annular groove opening in the direction toward one of the two axially perpendicular gaps between the rotor end face and the corresponding base plate (discharge side) and axially machined into the rotor or one of the base plates, and the connecting places of the flooding channels with the slot bottoms may be constructed as an aperture or recess in the shape of a circular arc axially machined into the other base plate (flooding side) and extending circumferentially over the suction or inlet area or areas, whereby exclusively the aperture(s) or recess(es) may have an unobstructed connection with the high pressure side of the installation.

In order that the fluid forces acting axially on the rotor can cancel each other far-reachingly, provision may be made appropriately that the apertures or recesses machined into the base plate on the flooding side of the rotor are constructed at least of approximately the same area as the corresponding area of the annular groove as regards the open area facing the axially perpendicular gap between the rotor and the plate.

In order to achieve also a completely satisfactory vane abutment at minimum rotational speeds of the pump, on the one hand, and in order not to permit the vane abutment to rise excessively high at maximum rotational speeds of the pump, on the other, it is advisable to so select the radial cross section of the annular line as regards its open cross-sectional area that the auxiliary feed flow which establishes itself by reason of the feed effect of the vanes sliding radially in the rotor slots, receives or undergoes a noticeable back pressure at minimum rotational speeds of the pump, yet that, on the other hand, the back pressure of this auxiliary feed flow remains still sufficiently far below that limit at maximum rotational speed of the pump, at which the radial abutment of the vanes at the cam surface threatens to cause a wear and scuffing of the parts. The cross section of the annular groove (by-pass or short-circuit line) effects the back pressure of the by-passed feed flow of the "auxiliary pump" responsible for the abutment of the vanes in the pressure area. This cross section must therefore be designed corresponding to the indications given hereinabove. For that purpose, experimental and empirical possibilities, test data and the like are available to the person skilled in the art, without having to engage in any inventive activities which can be expected of him so that with the aforementioned indications he has received teachings leading in a concrete case to the desired goal. Even though the aimed-at starting improvement of the pump under cold condition is completely achieved by means of the by-pass line of the "auxiliary pump", it has been discovered that in particular with a pump operating at normal operating temperature, instabilities may be introduced into the by-pass flow by reason of the flow direction which is not unequivocally prescribed to the by-pass flow, which might become noticeable under certain circumstances as noise and a high-frequency fluttering of the vanes. As a result thereof, the production of chatter marks at the cam ring may be favored or a flush sealing abutment of the vane edge at the cam ring may be impaired. In order to eliminate these disadvantages so that the inventive concept can be realized without harm, provision may be appropriately made that the slot bottoms of the vanes respectively disposed in a discharge area are in flow-communication only with the slot bottoms of the vanes disposed in an adjacent suction area adjoining in a predetermined circumferential direction by way of an arcuately shaped channel formed by a stationary part at least with respect to its end walls determining the length dimension, and in that only the slot bottoms of the rotor disposed in the suction or inlet area or areas are directly in communication with the high pressure side of the installation and in that the connecting places of the arcuately shaped channels with the slot bottoms have as large as possible a spacing from the connecting places of the flooding channels with the slot bottoms.

Accordingly, the by-pass line is not continuous at all places but is interrupted at certain places so that only very defined pairings of suction or inlet and discharge areas and the slot bottoms thereof are interconnected. Unequivocal conditions are created thereby with respect to the flow direction of the by-pass stream and an unstable tilting over or a to-and-fro movement of the flow into the one or the other direction is no longer possible. The arcuately shaped channels may be constituted by a non-genuine annular groove in one of the base plates which is interrupted at certain places by cross webs or by an annular groove in the rotor, into which stationary cross webs immerse at certain circumferential places.

For favoring the by-pass flow in one direction and for decreasing flow resistances, it is appropriate if the arcuately shaped channel or channels and the end walls thereof are so arranged circumferentially that the equalization flow from the discharge area to the suction or inlet area takes place always in the operating direction of rotation. This means with the single-flooding vane cell device with a rotor arranged eccentrically within a circular cam surface that a circularly shaped groove extending over nearly 360° has to be interrupted at the place opposite the eccentricity. In the double-flooding construction with a rotor arranged concentrically in an approximately eliptically shaped cam ring, two arcuately shaped channels extending over about 180° must be provided whose butting places are arranged in the plane of the major half axis of the elipse.

Accordingly, it is an object of the present invention to provide a vane type mechanism which avoids by simple means the aforementioned shortcomings and drawbacks encountered in the prior art.

Another object of the present invention resides in a vane pump or motor which can be operated at cold temperatures and which eliminates possible shocks that are normally encountered when commencing the operation of the pump or motor while cold.

A further object of the present invention resides in a vane pump or motor which is simple in construction, utilizes relatively few parts, yet avoids fluttering and ensures proper operation under all conditions.

Still a further object of the present invention resides in a vane pump or motor which is characterized by smooth starting.

Another object of the present invention resides in a vane pump or motor, particularly for use in servo-steering systems of motor vehicles, which precludes spurious improper operations of the servo-steering system, thereby imparting the confidence of the driver as regards the steering system.

A further object of the present invention resides in a vane-type cell mechanism of the aforementioned type in which proper abutment of the vanes against the guide cam surface is assured under all operating conditions.

Another object of the present invention resides in a vane pump in which the liquid pressures causing abutment of the vanes can build up also at relatively small rotational speed with a relatively viscous flow medium.

Still another object of the present invention resides in a vane pump in which the feed effect is assured relatively early accompanied with a relatively soft starting thereof.

Still a further object of the present invention resides in a vane pump in which the contamination of the hydraulic medium with air, water or dirt is effectively precluded while the length of life and volumetric efficiency of the pump as well as its operating characteristics are improved.

A still further object of the present invention resides in a vane pump in which the danger of chatter marks at the cam surface are greatly minimized, if not precluded.

These and further objects, features and advantages of the present invention will become more apparent from the following description when taken in connection with the accompanying drawing which shows, for purposes of illustration only, two embodiments in accordance with the present invention, and wherein:

FIG. 1 is a longitudinal cross-sectional view, taken along the axis of rotation, through a vane pump or motor with a discharge of the working medium out of the slot bottom of the rotor in accordance with the present invention;

FIG. 2 is a transverse cross-sectional view through the pump or motor according to FIG. 1, perpendicular to the axis of rotation and taken along line II—II of FIG. 1;

FIGS. 3 and 4 are respectively plan views on one base plate each for the axial limitation of the sickle-shaped working spaces of the pump or motor into which are machined the feed and discharge channels for the operating cells and the flooding and emptying channels and the annular channel for the slot bottoms, each in axial view on the side thereof facing the rotor;

FIG. 5 is a cross-sectional view through the base plate according to FIG. 4, taken along line V—V; and FIG. 6 is a plan view on a modified embodiment of a base plate in accordance with the present invention and similar to FIG. 3.

Referring now to the drawing wherein like reference numerals are used throughout the various views to designate like parts, the pump or motor illustrated in FIGS. 1 and 2 includes a pump housing 1 in which is journalled the drive shaft 2 and in which are accommodated the essential pump parts. These pump parts consist of the rotor 3 non-rotatably mounted on the shaft 2 together with the vanes 4 as well as the two base plates 5 and 6 (FIGS. 4 and 3) and the cam ring 7. The pressure plates may—as parenthetically noted—be also components of the pump housing or of a housing part in another embodiment of the present invention. The last three-mentioned parts are retained by retaining pins 8 in a definite mutual circumferential and radial position and are secured against radial movements and against rotation. Axially the assembly opening of the pump housing is closed off sealingly by the closure lid 10 secured by means of a spring ring 9, utilizing a sealing ring 11 to achieve the desired sealing effect. The main parts 3 to 6 of the pump receive an axial basic compression independent of the pressure by a compression spring 12 mounted between the cover 10 and the upper base plate 5. The upper base plate 5 is additionally sealingly accommodated in the pump housing by the use of a sealing ring 13 and separates the pressure side of the pump (space 14) from the inlet or suction side (annular space 15). Both spaces 14 and 15 are adapted to be connected with a hydraulic system by way of connecting ports 16 and 17.

A force corresponding to the level of the feed pressure of the pump prevailing in the pressure space 14—high pressure side of the vane cell device—is exerted onto the upper base plate 5 by the feed pressure of the pump prevailing in the pressure space 5 which sealingly compresses the main parts 3 to 6 of the pump axially against the pressure forces prevailing on the inside of the pump.

Axially extending radially disposed slots 18 with parallel walls are machined into the rotor 3, into which are inserted plane-parallel rectangular metal plates, the so-called vanes 4, which are able to slide therein with a slight predetermined play or clearance. The vanes 4 are exactly as long in the axial direction as the rotor 3 and the cam ring 7. The inner contour 19 of the cam ring 7 is constructed oval (FIG. 2) according to a predetermined endless curved configuration so that two sickle-shaped working spaces 20 result between the rotor 3 and the curved surface 19, through which pass rapidly in the circumferential direction the vanes 4 subdividing these working spaces into cells during the rotation of the rotor. The cam surface 19 is inclined radially outwardly with respect to the circumferential direction within the areas of the line 21 during the rotation of the rotor in the direction of arrow 22 (FIG. 1) and the feed cells formed between the vanes 4 become larger within this area (suction or inlet area). The suction or inlet areas of the sickle-shaped working spaces 20 receive a direct connection with the ring-shaped feed space 15 by corresponding apertures or recesses 23 and 24 (FIGS. 3 and 4) at the lower base plate 6 (FIG. 3) and at the upper base plate 5 (FIG. 4). These apertures 23 and 24 represent the internal connecting channels of the suction or inlet side of the working spaces with the annular space 15. Within the angular area of the line 25 (FIG. 2) the cam surface 19 is inclined radially inwardly with respect to the circumferential direction so that during the rotation of the rotor, the cells become smaller within this area. The flow medium contained therein is displaced axially on both sides whereby on the top rotor side as viewed in FIG. 1 it is able to reach the pressure space 14 by way of the through-apertures 26 in the plate 5 and on the lower side of the rotor, by way of the apertures 27 in plate 6 constructed as recesses, by way of the return bores 28 in the cam ring 7 and also by way of the apertures 26.

The vanes 4 which during the rotation of the rotor follow radially the inner contour 19 of the cam ring 7, move radially outwardly within the rotor slots during the passage through the suction or inlet area 21 and the corresponding slot bottoms 29 which become larger at that time, thereby fill up by way of the circularly shaped arcuate apertures 30 (FIGS. 1, 4 and 5) which extend over the angular space of the suction or inlet area, are arranged along the radius of the slot bottoms and are unobstructedly in communication with the pressure space 14, whereby the apertures 30 represent the flooding channels for the slot bottoms passing through the suction or inlet area. These flooding channels 30 are provided only in one and more particularly in the upper base plate 5. The rotor side facing the upper gap between the rotor and the base plate 5 is therefore the flooding side, from which—if necessary—the slot bottoms of the rotor are flooded from the outside. As a result of this unobstructed admission of the working medium into the slot bottoms within the suction or inlet area, a fluid pressure corresponding to the high pressure level in the space 14 is exerted on the vanes 4 and additionally a rapid flooding of these spaces is made possible which increase in volume, i.e., become larger.

During the passage of the rotor vanes 4 through a discharge area of the pump, these vanes are forcibly displaced radially inwardly by the configuration of the cam surface 19 and liquid is thereby displaced out of the volumes of the slot bottoms which now become smaller. This displaced working medium may in the illustrated pump escape axially out of the slot bottoms exclusively on one side and more particularly into the annular groove 31 (FIGS. 1 and 2) provided in the lower base plate 6 along the diameter of the slot bottoms. Since the annular groove 31 is provided only in the lower base plate 6, the slot bottoms of the discharge area can discharge axially only toward this side of the rotor (emptying or discharge side of the rotor). This annular groove 31 represents a part of the discharge or emptying line for the slot bottoms which become smaller when they pass through the discharge area. The slot bottoms in this area, more particularly, are thus in communication with the pressure space 14 by way of the slot bottoms disposed in the suction area and by way of the flooding apertures 30. Working oil displaced by the vanes out of the slot bottoms within the discharge area must therefore escape by way of a by-pass through the slot bottoms disposed in the suction area. Since however the slot bottoms disposed in the suction or inlet area become larger at that moment, they are in a position to absorb the oil displaced elsewhere. Consequently, a line by-pass between the slot bottoms which become larger and those which become smaller is created by the annular groove 31. Oil constantly flows through the annular groove 31 out of the discharge area into the suction or inlet area. In contrast thereto, oil is constantly supplied in the reverse direction in the slot bottoms of the rotor. A system closed in itself is created by the by-pass line, on which is superimposed externally exclusively the feed pressure of the pump and to which eventual leakage quantities are supplied. By the corresponding dimensioning of the flow cross section of the by-pass line 31 (visible in FIG. 1), a certain damming or throttling effect producing a back-pressure can be exerted on the short-circuited or by-passed flow in such a manner that an unequivocal outwardly directed back-pressure and abutment force is exerted on the radially inwardly moving rotor vanes which are disposed in the exhaust or discharge area. It can be achieved by a proper dimension of the area of the annular groove 31 facing the gap on the discharge side of the rotor (visible in FIG.3) that the forces acting axially on the rotor from the apertures 30 from the flooding side are equalized by means of the forces acting axially on the same from the discharge side as a result of the pressure in the annular groove 31.

It is achieved according to the present invention by the by-pass line 31 establishing a direct connection of the slot bottoms between the suction or inlet and discharge area that the oil displaced out of the slot bottoms in the discharge area at first has to flow through the slot bottoms disposed in the suction or inlet area before the oil has the possibility of an escape or flow into the pressure space 14. As a result thereof, a force independent of the rotational speed and of the pressure build-up in the space 14 is being built up and applied on the rotor vanes disposed in the suction or inlet area especially with a cold viscous and adhesive working medium which greatly favors a commencement of the pump action during the starting and very strongly reduces the initial rotational speed. An early and soft pressure build up already at very small rotational speeds is the result. In order that the oil flowing off out of the slot bottoms in the discharge area by way of the slot bottoms in the suction or inlet area encounters as large a flow resistance as possible prior to the discharge into the space 14 and in order that the radially outwardly directed pressure force on the rotor vanes disposed in the suction or inlet area is as large as possible, the entire available length of the slot bottoms is included into the discharge or emptying paths, on the one hand, and it is assured by reason of a corresponding construction and configuration of the slot depth, of the radial vane dimension and of the form of the vane rear edge, on the other, that the discharge or emptying cross section (visible in FIG. 2) is as small as possible.

In a pump or motor with a base plate according to FIG. 6, the working medium displaced out of the slot bottoms may also escape axially only on one side and more particularly into the arcuate grooves 31*a* and 31*b* provided in the lower base plate along the diameter of the slot bottoms, which arcuate grooves are provided in this modified embodiment of the base plate of FIG. 6 in lieu of the annular groove 31 illustrated in FIG. 3. Since the grooves 31*a* and 31*b* are provided only in the lower base plate 6, the slot bottoms of the discharge area can empty out axially also in this case only toward this side of the rotor (discharge side of the rotor). These arcuate grooves 31*a* and 31*b* represent like the annular groove 31, a part of the discharge or emptying line for the slot bottoms which become smaller when passing through the discharge area. More particularly, also in this embodiment, the slot bottoms within this area are in communication with the pressure space 14 by way of a part of the grooves, by way of the slot bottoms disposed in the suction or inlet area and by way of the flooding apertures 30. Working oil displaced by the vanes 4 in the discharge area out of the slot bottoms must therefore escape by way of a by-pass through the slot bottoms disposed in the suction or inlet area. Since the slot bottoms which are disposed thereat are enlarged at that moment, they are in a position to absorb the oil displaced elsewhere. Consequently, a line by-pass between the slot bottoms which become larger and those which become smaller is created by the grooves 31*a* and 31*b* as by the annular groove 31. Oil flows constantly through the arcuate grooves 31*a* and 31*b* out of the discharge area into the suction or inlet area. In contrast thereto, oil is constantly supplied in the slot bottoms of the rotor in the reverse direction. A system also closed in itself by the arcuate grooves is created by the by-pass line on which is superimposed externally only the feed pressure of the pump and to which are supplied eventual leakage quantities. The arcuate grooves 31*a* and 31*b* are separated from one another at their place of contact by a cross web 32. The subdivision of the by-pass line into separate lines for each adjacent pair of suction or inlet and discharge areas which is effected in this manner, is the cause for a continuous unequivocal flow direction of the by-pass flow. One of the arcuate grooves 31*a* and 31*b* each extends over a pair of adjacent working areas and the flow direction in the arcuate groove proceeds always from the discharge area to the suction or inlet area of the encompassed pair. The cross webs 32 are arranged between two working areas of the pump at such a circumferential place that within the pair of working areas encompassed by an arcuate groove, initially the discharge area and then the suction or inlet area follows in the direction of rotation which means that the cross webs 32 have to be arranged in the plane of the major symmetry axis of the cam surface 19. As a result thereof, the by-pass stream always flows through the arcuate groove in the direction of rotation of the rotor.

For purposes of completion, it should also be mentioned that at the circumferential places of the rotor or stator at which the cross webs are arranged, flow cross sections must not be present on the axially oppositely disposed rotor side or base plate, for example, at the base plate 5, which might enable an escape out of this cross section by a by-pass flow. The arcuate groove 30 therefore must not extend over the circumferential place of the cross web 32.

While I have shown and described two embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A vane cell installation for liquid flow media which comprises a rotor means provided with at least approximately radial slot means, vane means slidable within said slot means, an endless cam surface means surrounding the rotor means and radially enclosing together with the rotor means at least one sickle-shaped working space means, the cam surface means having a radially outwardly directed inclination with respect to a circular surface concentric to the center of rotation of the rotor means which forms an inlet area during transversal of the cam surface means in a predetermined direction corresponding to the operating direction, and a corresponding radially inwardly directed inclination in at least one other circumferential area of the cam surface means forming a discharge area, two essentially plane base plate means axially sealingly enclosing on both sides the rotor means together with the vane means and the cam surface means and axially delimiting the working space means, internal connecting channel means connecting the inlet area of the working space means with a feed channel means and connecting the discharge area of the working space means with a discharge channel means, a working medium supply means from a part of the system which is subjected to the higher pressure level, to bottoms of the slot means of the rotor means disposed in the inlet area by way of flooding channel means and a working medium discharge means out of the bottom of the slot means of the rotor means disposed in the discharge area toward the high pressure side of the installation by way of emptying channel means, characterized in that the working medium discharge means takes place exclusively by way of a by-pass means including at least a partial area of the axial extent of the bottoms of the slot means of the rotor means disposed in the inlet area, and in that the flooding channel means to said last-mentioned bottoms of the slot means terminates in said slot bottoms at an axial position thereof disposed downstream with respect to the connecting place of the emptying channel means, as viewed in the flow direction of the working medium discharge.

2. An installation according to claim 1, characterized in that all slot bottoms of the rotor means are in flow communication with each other by at least one annular channel means, and in that only the slot bottoms of the rotor means disposed in the inlet area are in direct communication with the high pressure side of the installation.

3. An installation according to claim 1, characterized in that the slot depth and the contour of the vane edge facing the slot bottom as well as the slot bottom itself are so constituted that the remaining open cross section between the vane edge and the slot bottom is relatively small in the radially furthest pushed-back position of the vane means.

4. An installation according to claim 1, characterized in that the connecting places of the annular channel means and of the flooding channel means with the slot bottoms are arranged at the two axially mutually opposite end faces fo the rotor means.

5. An installation according to claim 1, characterized in that the connecting places of the annular channel means with the slot bottoms has an axial spacing from the connecting place of the flooding channel means with the slot bottoms which is relatively large.

6. An installation according to claim 5, characterized in that the annular channel means is formed by an annular groove.

7. An installation according to claim 1, characterized in that all slot bottoms of the rotor means are in flow communication with each other by at least one annular channel means, the annular channel means is constructed as an annular groove opening toward one of the two axially perpendicular gaps between an end face of the rotor means and the corresponding base plate means and axially machined into one of the two parts consisting of rotor means and base plate means.

8. An installation according to claim 7, characterized in that the connecting places of the flooding channel means with the slot bottoms are constructed as aperture means machined axially into the other base plate means and circumferentially extending substantially circularly shaped over the corresponding inlet area, exclusively said aperture means having a substantially unimpaired connection with the high pressure side of the installation.

9. An installation according to claim 8, characterized in that the aperture means machined into the base plate means on the flooding side of the rotor means are constructed with respect to the open surface facing the axially perpendicular gap between rotor means and base plate means at least approximately of the same area as the corresponding area of the annular groove channel means.

10. An installation according to claim 1, characterized in that the slot bottoms of the vane means disposed respectively in a discharge area are in-flow communication with the respective slot bottoms of the vane means disposed in the adjacent inlet area which is located adjacent in a predetermined circumferential direction, by way of respective arcuately shaped channel means, and in that only the slot bottoms of the rotor means disposed in the inlet area are in communication directly with the high pressure side of the installation.

11. An installation according to claim 10, characterized in that each arcuately shaped channel means is formed by a stationary part at least with respect to the end walls thereof determining its axial dimension.

12. An installation according to claim 10, characterized in that the connecting places of the arcuately shaped channel means with the slot bottoms have a relatively large axial spacing from the connecting place of the flooding channel means with the slot bottoms.

13. An installation according to claim 10, characterized in that the arcuately shaped channel means and the end walls thereof are so arranged circumferentially that the equalization flow from the discharge area to the inlet area always takes place in the normal direction of rotation.

14. An installation according to claim 1, characterized in that the working medium supply means is substantially unobstructed while the working medium discharge means is throttled.

15. An installation according to claim 14, characterized in that the working medium supply means takes place out of one of the two channel means consisting of feed and discharge channel means which is subjected to the higher pressure level.

16. An installation according to claim 14, characterized in that the channel means subjected to the higher pressure is a corresponding internal connecting channel means.

17. An installation according to claim 14, characterized in that the slot means have substantially parallel walls.

18. An installation according to claim 14, characterized in that the rotor means and the vane means as well as the ring means carrying the cam surface means have substantially the same axial length and are delimited by plane surfaces disposed axially perpendicular.

19. An installation according to claim 18, characterized in that all slot bottoms of the rotor means are in flow communication with each other by at least one annular channel means, and in that only the slot bottoms of the rotor means disposed in the inlet area are directly in communication with the high pressure side of the installation.

20. An installation according to claim 19, characterized in that the connecting places of the annular channel means with the slot bottoms has an axial spacing from the connecting place of the flooding channel means with the slot bottoms which is relatively large.

21. An installation according to claim 20, characterized in that the annular channel means is formed by an annular groove.

22. An installation according to claim 20, characterized in that the slot depth and the contour of the vane edge facing the slot bottom as well as the slot bottom itself are so constituted that the remaining open cross section between the vane edge and the slot bottom is relatively small in the radially furthest pushed-back position of the vane means.

23. An installation according to claim 22, characterized in that the connecting places of the annular channel means and of the flooding channel means with the slot bottoms are arranged at the two axially mutually opposite end faces of the rotor means.

24. An installation according to claim 22, characterized in that the annular channel means is constructed as an annular groove opening toward one of the two axially perpendicular gaps between an end face of the rotor means and the corresponding base plate means and axially machined into one of the two parts consisting of rotor means and base plate means.

25. An installation according to claim 24, characterized in that the connecting places of the flooding channel means with the slot bottoms are constructed as aperture means machined axially into the other base plate means and circumferentially extending substantially circularly shaped over the corresponding inlet area, exclusively said aperture means having a substantially unimpaired connection with the high pressure side of the installation.

26. An installation according to claim 25, characterized in that the aperture means machined into the base plate means on the flooding side of the rotor means are constructed with respect to the open surface facing the axially perpendicular gap between rotor means and base plate means at least approximately of the same area as the corresponding area of the annular groove channel means.

27. A pump according to claim 26, characterized in that the radial cross section of the annular channel means is so selected as regards its open cross-sectional area that the auxiliary feed flow which establishes itself by reason of the feed action of the vane means radially sliding in the rotor slot means, receives at minimum rotational speeds of the pump a noticeable back pressure but, on the other, the back pressure of this auxiliary feed flow at maximal rotational speeds of the pump remains sufficiently far below that limit at which the radial abutment of the vane means at the cam surface means menaces to cause a wear of the parts by reason of the back pressure.

28. A pump according to claim 26, characterized in that the radial cross section of the annular groove is so selected as regards its open cross-sectional area that the auxiliary feed flow which establishes itself by reason of the feed action of the vane means radially sliding in the rotor slot means, receives at minimum rotational speeds of the pump a noticeable back pressure but, on the other, the back pressure of this auxiliary feed flow at maximal rotational speeds of the pump remains sufficiently far below that limit at which the radial abutment of the vane means at the cam surface means menaces to cause a wear of the parts by reason of the back pressure.

29. An installation according to claim 28, characterized in that at least two annular channel means are provided and fashioned as arcuately shaped channel means, the slot bottoms of the vane means disposed respectively in a discharge area are in-flow communication with the respective slot bottoms of the vane means disposed in adjacent inlet area which is located adjacent in a predetermined circumferential direction, by way of the respective arcuately shaped channel means, and in that only the slot bottoms of the rotor means disposed in the inlet area are in communication directly with the high pressure side of the installation.

30. An installation according to claim 29, characterized in that each arcuately shaped channel means is formed by a stationary part at least with respect to the end walls thereof determining its axial dimension.

31. An installation according to claim 30, characterized in that the connecting places of the arcuately shaped channel means with the slot bottoms have a relatively large axial spacing from the connecting place of the flooding channel means with the slot bottoms.

32. An installation according to claim 31, characterized in that the arcuately shaped channel means and the end walls thereof are so arranged circumferentially that the equalization flow from the discharge area to the inlet area always takes place in the normal direction of rotation.

* * * * *

UNITED STATES PATENT OFFICE

CERTIFICATE OF CORRECTION

Patent No. 3,973,881 Dated August 10, 1976

Inventor(s) Wilhelm Melchinger

It is certified that error appears in the above-identified patent and that said Letters Patent are hereby corrected as shown below:

The drawing figure on the cover sheet should be cancelled and substitute the following figure therefor.

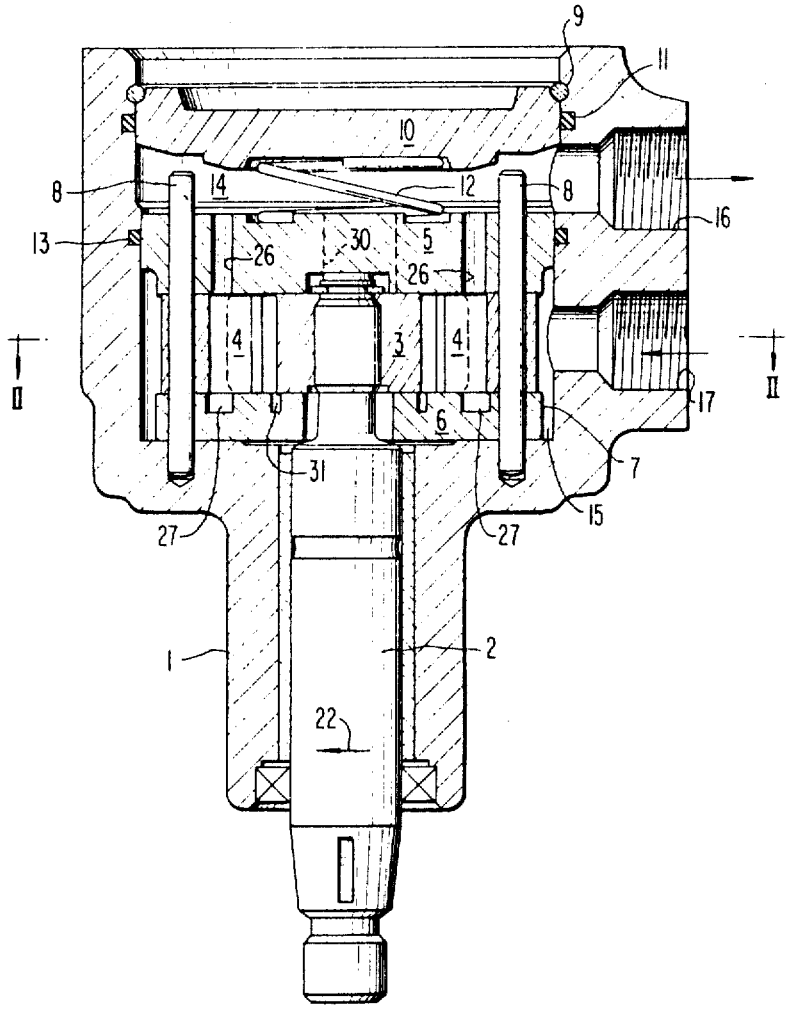

Signed and Sealed this

First Day of February 1977

[SEAL]

*Attest:*

RUTH C. MASON
*Attesting Officer*

C. MARSHALL DANN
*Commissioner of Patents and Trademarks*